US009323165B2

(12) United States Patent
Takao et al.

(10) Patent No.: US 9,323,165 B2
(45) Date of Patent: Apr. 26, 2016

(54) ELECTROPHOTOGRAPHIC PHOTORECEPTOR AND IMAGE FORMING APPARATUS

(71) Applicant: Konica Minolta, Inc., Tokyo (JP)

(72) Inventors: Hiroki Takao, Tokyo (JP); Kazunori Kurimoto, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 33 days.

(21) Appl. No.: 14/215,665

(22) Filed: Mar. 17, 2014

(65) Prior Publication Data

US 2014/0287351 A1 Sep. 25, 2014

(30) Foreign Application Priority Data

Mar. 25, 2013 (JP) ..... 2013-061491

(51) Int. Cl.
*G03G 15/04* (2006.01)
*G03G 5/147* (2006.01)

(52) U.S. Cl.
CPC ..... *G03G 5/14704* (2013.01); *G03G 5/14791* (2013.01); *G03G 5/14795* (2013.01)

(58) Field of Classification Search
CPC ..... G03G 5/14704; G03G 5/14791; G03G 5/14795
USPC ..... 430/56, 66, 69, 84; 399/159
See application file for complete search history.

(56) References Cited

U.S. PATENT DOCUMENTS

2004/0234294 A1* 11/2004 Nagame et al. ..... 399/159

FOREIGN PATENT DOCUMENTS

| | | | |
|---|---|---|---|
| JP | 52-026226 | | 2/1977 |
| JP | H06-250430 | * | 9/1994 |
| JP | H06-258857 | | 9/1994 |
| JP | H11-202531 | | 7/1999 |
| JP | H11-295914 | | 10/1999 |
| JP | 2003005394 A | | 1/2003 |
| JP | 2010134459 | | 6/2010 |
| JP | 2011145457 | | 7/2011 |

OTHER PUBLICATIONS

English translation of Office Action issued Mar. 24, 2015 for the corresponding Japanese Patent Application No. 2013-061491.

* cited by examiner

*Primary Examiner* — Thorl Chea
(74) *Attorney, Agent, or Firm* — Lucas & Mercanti, LLP

(57) ABSTRACT

Disclosed are an electrophotographic photoreceptor which has high durability and high potential characteristics and can suppress the occurrence of stick-slip and turning up of a blade and the abrasion of the blade even when the blade is used as a cleaning unit. The surface layer contains barium sulfate composite fine particles, in which a conductive metal oxide is adhered to the surface of a core material made from barium sulfate, in a cured resin. The 10 point average roughness RzJIS of the surface layer is not less than 0.2 μm and not more than 1.5 μm, and a value obtained by an equation n×d, wherein n represents the peak count of the surface layer and d represents the number average primary particle diameter of the barium sulfate composite fine particles, is not less than 10,000 (pieces·nm) and not more than 200,000 (pieces·nm).

8 Claims, 4 Drawing Sheets

ELECTROPHOTOGRAPHIC PHOTORECEPTOR AND IMAGE FORMING APPARATUS

CROSS REFERENCE TO RELATED APPLICATION

This Application claims the priority of Japanese Patent Application No. 2013-061491 filed on Mar. 25, 2013, which is incorporated by reference herein.

TECHNICAL FIELD

The present invention relates to an electrophotographic photoreceptor provided in an image forming apparatus of an electrophotographic system and an image forming apparatus.

BACKGROUND ART

An inorganic photoreceptor and an organic photoreceptor have been conventionally known as an electrophotographic photoreceptor (which, hereinafter, may also be simply referred to as "photoreceptor") used in an image forming apparatus of an electrophotographic system. The "electrophotographic system" used herein is generally the following image forming process. A photoconductive photoreceptor is first charged, for example, by corona discharge in a dark place, and then exposed to an image to selectively dissipate charges only on an exposed portion, thereby obtaining an electrostatic latent image. This latent image is developed with a toner containing a colorant such as a dye and a pigment and a resin material, so that the latent image is made visible to form an image.

The organic photoreceptor has advantages in terms of degree of freedom of a photosensitive wavelength region, film forming property, flexibility, transparency of a film, mass productivity, toxicity, and cost, as compared to the inorganic photoreceptor. For this reason, the organic photoreceptor is currently used as most photoreceptors.

For a photoreceptor repeatedly used in the image forming process of the electrophotographic system, it is necessary that electrostatic characteristics typified by sensitivity, receptor potential, potential retention, potential stability, residual potential, said spectral sensitivity characteristics are excellent.

In order to improve the cleaning property of the photoreceptor, a process of roughening the surface of such a photoreceptor has been known. For example, in Patent Literatures 1 and 2 the addition of organic fine particles or inorganic fillers to a surface layer of a photoreceptor is disclosed as the process of roughening the surface of the photoreceptor.

However, such a photoreceptor has the problem in that the film strength decreases and the potential increases. Further, when a photoreceptor having coarse and large particles present on the surface is cleaned using a blade as a cleaning unit, the frictional force between the photoreceptor and the blade or the torque increases. As a result, the stick-slip and the turning up (reversal) of the blade occur. In addition, there are problems such as the abrasion of the blade.

CITATION LIST

Patent Literature

Patent Literature 1: Japanese Patent Application Laid-Open No. Sho. 52-26226

Patent Literature 2: Japanese Patent Application Laid-Open No. 2003-5394

SUMMARY OF INVENTION

Technical Problem

The present invention has been made in view of the foregoing circumstances and has as its object the provision of an electrophotographic photoreceptor which has high durability and high potential characteristics and can suppress the occurrence of stick-slip and turning up of a blade and the abrasion of the blade even when the blade is used as a cleaning unit, and as another object the provision of an image forming apparatus equipped with the electrophotographic photoreceptor.

Solution to Problem

In order to achieve at least one of the above-described objects, an electrophotographic photoreceptor that reflects one aspect of the present invention includes a conductive support, a photosensitive layer formed on the conductive support, and a surface layer formed on the photosensitive layer. In the electrophotographic photoreceptor, the surface layer contains barium sulfate composite fine particles in a cured resin, wherein the barium sulfate composite fine particles is composed of a core material made from barium sulfate and a conductive metal oxide adhered, to the surface of the core material; a 10 point average roughness RzJIS of the surface layer is not less than 0.2 μm and not more than 1.5 μm; and a value obtained by an equation n×d is not less than 10,000 (pieces·nm) and not more than 200,000 (pieces·nm) where n represents a peak count of the surface layer and d represents a number average primary particle diameter of the barium sulfate composite fine particles.

In the above-described electrophotographic photoreceptor, the number average primary particle diameter of the barium sulfate composite fine particles is preferably 50 to 500 nm, more preferably 75 to 300 nm.

Further, it is preferable that the barium sulfate composite fine particles are those subjected to a surface treatment with a surface treating agent having a polymerizable functional group.

Moreover, the content of the barium sulfate composite fine particles in the surface layer is preferably 10 to 200 parts by mass per 100 parts by mass of the cured resin.

In the above-described electrophotographic photoreceptor, it is preferable that the conductive metal oxide in the barium sulfate composite fine particles is at least one kind selected from the group consisting of tin oxide, titanium oxide, zinc oxide, zirconia and indium tin oxide.

In the above-described electrophotographic photoreceptor, the value obtained by the equation n×d is preferably not less than 20,000 (pieces·nm) and not more than 150,000 (pieces·nm).

The peak count (n) of the surface layer is preferably 20 to 100 pieces per length of 8.0 mm.

In order to achieve at least one of the objects, an image forming apparatus that reflects one aspect of the present invention includes an electrophotographic photoreceptor, a charging unit for charging the surface of the electrophotographic photoreceptor, an exposure unit for forming an electrostatic latent image on the surface of the electrophotographic photoreceptor, a developing unit for developing the electrostatic latent image with a toner to form a toner image, a transfer unit for transferring the toner image to a transfer material, a fixing unit for fixing the toner image transferred to the transfer material, and a cleaning unit for removing a residual toner on the electrophotographic photoreceptor, wherein the electrophotographic photoreceptor is the above-described electrophotographic photoreceptor.

In the above-described image forming apparatus, it is preferable that the cleaning unit is a blade.

Advantageous Effects of Invention

According to the electrophotographic photoreceptor, the 10 point average roughness RzJIS of the surface layer in which the barium sulfate composite fine particles are contained in the cured resin falls within a specific range, and the value obtained by the equation (the peak count n of the surface layer×the number average primary particle diameter d of the barium sulfate composite fine particles) falls within a specific range, that is, the number and the size of barium sulfate composite fine particles exposed on the surface layer fall within specific ranges. For this reason, the electrophotographic photoreceptor has high durability and high potential characteristics. Further, even when the cleaning unit such as a blade is used for cleaning, the frictional force between the photoreceptor and the blade or the torque decreases. Therefore, the occurrence of stick-slip and turning up of the blade and the abrasion of the blade can be suppressed.

Since the image forming apparatus includes above-described the electrophotographic photoreceptor, a high-quality image can be formed over a long period of time.

DESCRIPTION OF EMBODIMENTS

Figure 1:
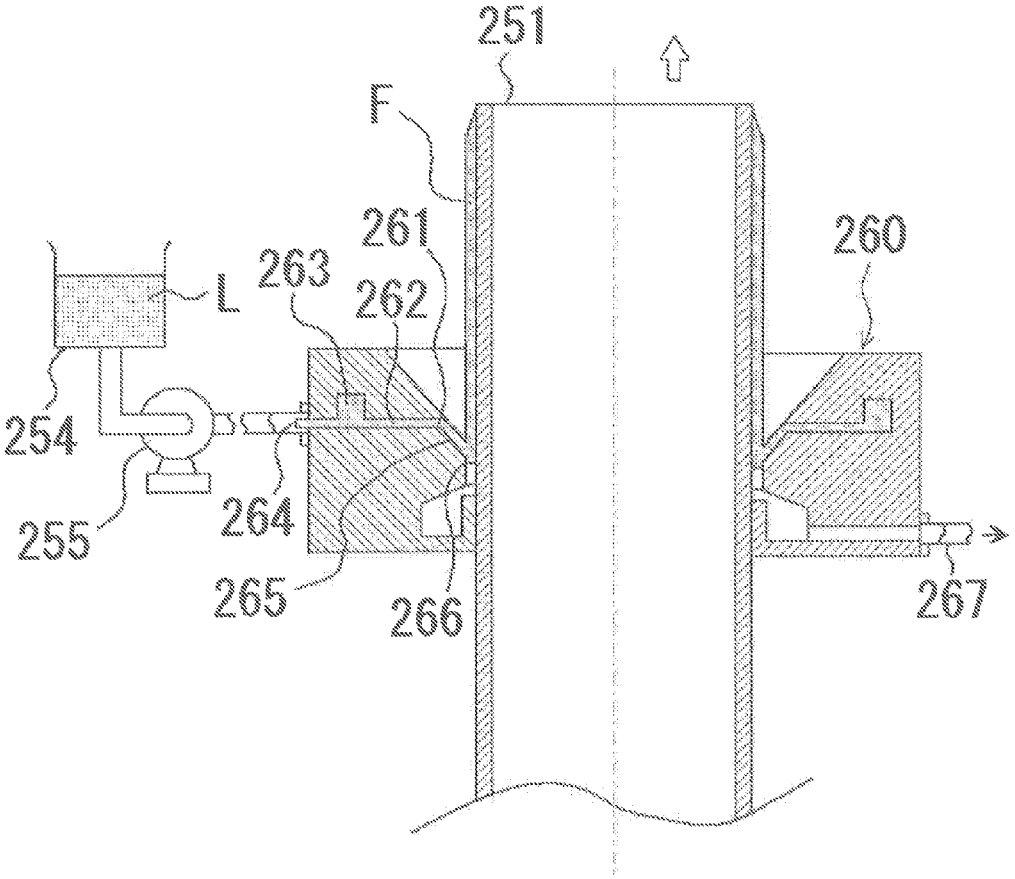
FIG. 1 is a cross-sectional view illustrating one example of the configuration of a circular slide hopper coater used in a production process of a photoreceptor of the present invention.

Hereinafter, the present invention will be described in detail.

Electrophotographic Photoreceptor:

A photoreceptor of the present invention is not particularly limited as long as a photosensitive layer and a surface layer are stacked in this order on a conductive support. As specific examples thereof, may be mentioned the following layer structures (1) and (2):

(1) a layer structure in which an intermediate layer, a charge generating layer and a charge transporting layer, which serve a photosensitive layer, and a surface layer are stacked in this order on a conductive support; and (2) a layer structure in which an intermediate layer, a single layer including a charge, generating substance and a charge transporting substance, which serves as a photosensitive layer, and a surface layer are stacked in this order on a conductive support.

The photoreceptor of the present invention is an organic photoreceptor. The organic photoreceptor refers to an electrophotographic photoreceptor in which at least one of a charge generating function and a charge transporting function essential for the structure of the electrophotographic photoreceptor is exerted by an organic compound. As examples of the organic photoreceptor, may be mentioned a photoreceptor including a publicly known organic charge generating substance or organic charge transporting substance and a photoreceptor in which the charge generating function and the charge transporting function are exerted by a polymer complex.

Surface Layer:

The surface layer constituting the photoreceptor of the present invention is formed on the photosensitive layer. The surface layer contains barium sulfate composite fine particles, in which a conductive metal oxide is adhered to the surface of a core material made from barium sulfate, in a cured resin.

Since the main component of the surface layer in the photoreceptor of the present invention is a cured resin, high film strength can be essentially obtained. Therefore, high durability can be achieved. Further, since the conductive metal oxide constitutes the barium sulfate composite fine particles contained as the cured resin, high potential characteristics can be achieved.

The 10 point average roughness RzJIS of the surface layer is not less than 0.2 μm and not more than 1.5 μm, preferably not less than 0.3 μm and not more than 0.7 μm. The value obtained by the equation n×d, wherein n represents the peak count of the surface layer and d represents the number average primary particle diameter of the barium sulfate composite fine particles, is not less than 10,000 (pieces·nm) and not more than 200,000 (pieces·nm), preferably not less than 20,000 (pieces·nm) and not more than 150,000 (pieces·nm).

The 10 point average roughness RzJIS of the surface layer falls within the above-described range and the value obtained by the equation n×d falls within the above-described range, that is, the 10 point average roughness RzJIS of the surface layer fails within a specific range and the number and the size of barium sulfate composite fine particles exposed on the surface of the surface layer fall within specific ranges. For this reason, even when the cleaning unit such as a blade is used for cleaning, the frictional force between the photoreceptor and the blade or the torque decreases. Therefore, the occurrence of stick-slip and turning up of the blade and the abrasion of the blade can be suppressed, and the cleaning property can be improved.

When the 10 point average roughness RzJIS of the surface layer is less than 0.2 μm or the value obtained by the equation n×d is less than 10,000 (pieces·nm), the abrasion loss of the blade increases, and the cleaning property deteriorates. In contrast, when the 10 point average roughness RzJIS of the surface layer is more than 1.5 μm or the value obtained by the equation n×d is more than 200,000 (pieces·nm), the frictional force between the photoreceptor and the blade or the torque increases. As a result, the abrasion loss of the blade increases, and the cleaning property deteriorates.

In the present invention, the 10 point average roughness RzJIS of the surface layer is measured as follows.

Here, the 10 point average roughness RzJIS is described in JIS B0601; 2001 appendix. From a roughness curve, a portion having only a standard length in a direction of an average line is cut out, and a distance (absolute value of true height) from the average line of the cut portion to a peak/valley in a vertical magnification direction is measured. Specifically, the average of absolute values of true heights of 5 peaks from the highest one in the vertical magnification direction and the average of absolute values of true heights of 5 valleys from the lowest one in the vertical magnification direction is calculated and summed. The total is expressed in micrometers (μm) to serve as the 10 point average roughness RzJIS. In the present invention, the 10 point average roughness RzJIS is measured under conditions of a standard length λc of 0.08 mm, an evaluation length L of 8 mm, and a measurement speed of 0.15 mm/sec. A surface roughness meter "SURFCOM 1400D" (manufactured by TOKYO SEIMITSU Co., Ltd.) is used for the measurement.

In the present invention, the peak count (n) of the surface layer is measured as follows.

The peak count (n) is defined by ASME (American Society of Mechanical Engineers) B46.1-1995. The peak count (n) represents the number of peaks, which each cross a lower reference level −H and an upper reference level +H, in an evaluation length. In the present invention, the peak count is the number of peaks measured in a length of 8.0 mm at lower and upper reference levels Hs of ±0.02 μm. A surface roughness meter "SURFCOM 1400D" (manufactured by TOKYO SEIMITSU Co., Ltd.) is used for the measurement.

In the present invention, the peak count (n) of the surface layer is preferably 20 to 1,000 pieces, more preferably 100 to 600 pieces per length of 8.0 mm.

Cured Resin:

The cured resin constituting the surface layer is obtained, by curing a polymerizable compound. Specifically, a polymerizable compound is polymerized by irradiation with actinic radiation such as ultraviolet light and electron beams, to obtain the cured resin.

In the present invention, as the polymerizable compound, a compound having two or more polymerizable functional groups may preferably be used. Further, a compound having one polymerizable functional group may be used in combination. As specific examples of the polymerizable compound, may be mentioned a styrene-based monomer, an acrylic monomer, a methacrylic monomer, a vinyl toluene-based monomer, a vinyl acetate-based monomer, and an N-vinyl pyrrolidone-based monomer.

It is particularly preferable that the polymerizable compound is an acrylic monomer having two or more acryloyl groups ($CH_2{=}CHCO{-}$) or methacryloyl groups ($CH_2{=}CCH_3CO{-}$) as polymerizable functional groups or an oligomer thereof. This is because they can be cured by a small light amount or in a short period of time.

In the present invention, the polymerizable compounds may be used either singly or in a mixture thereof. Moreover, the polymerizable compounds may be used as a monomer or after oligomerization.

Specific examples of the polymerizable compounds may include as follows.

[Chemical Formula 1]

M1

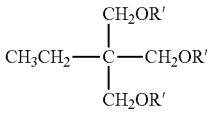

M2

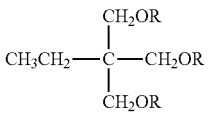

M3

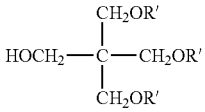

-continued

M4

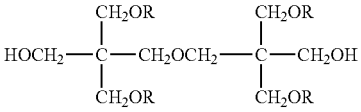

M5

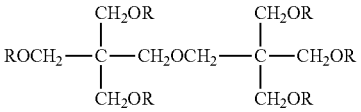

M6

M7

[Chemical Formula 2]

M8

M9

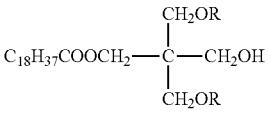

M10

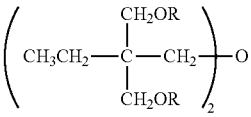

M11

M12

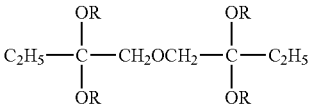

M13

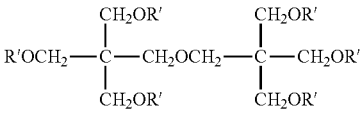

M14

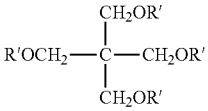

In the formulae representing the compounds (M1) to (M14), R represents an acryloyl group ($CH_2{=}CHCO{-}$) and R' represents a methacryloyl group ($CH_2{=}CCH_3CO{-}$).

Barium Sulfate Composite Fine Particles

The surface layer contains barium sulfate composite fine particles in which a conductive metal oxide is adhered to the surface of a core material made from barium sulfate. The barium sulfate composite fine particles each have a core-shell structure in which part or all of the surface of barium sulfate as the core material is covered with the conductive metal oxide as a covering material.

The number average primary particle diameter (d) of the barium sulfate composite fine particles is preferably 50 to 500 nm, more preferably 75 to 300 nm.

When the number average primary particle diameter (d) of the barium sulfate composite fine particles falls within the above-described range, the 10 point average roughness RzJIS of the surface layer and the value obtained by the equation n×d fall within the above-described respective ranges.

In the present invention, the number average primary particle odometer (d) of the barium sulfate composite fine particles is measured as follows.

The barium sulfate composite fine particles are observed and photographed by a transmission electron microscope at a magnification of 10,000, to obtain an image. The number average primary particle diameter (d) of the barium sulfate composite fine particles is calculated from 100 fine particles randomly selected from the photographed image. Specifically, the horizontal Feret diameters of the 100 particles are measured by an image analysis process and the average thereof is calculated as the number average primary particle diameter. The image analysis process can be executed automatically, for example, by a program stored in a transmission electron microscope. In the present invention, a transmission electron microscope "JEM-2000FX" (manufactured by JEOL Ltd.) is used for particle diameter measurement of the fine particles.

The content of the barium sulfate composite fine particles in the surface layer is preferably 10 to 200 parts by mass per 100 parts by mass of the cured resin.

When the content of the barium sulfate composite fine particles falls within the above-described range, the 10 point average roughness RzJIS of the surface layer and the value obtained by the equation n×d fall within the above-described respective ranges.

In the present invention, since barium sulfate is used as the core material for the barium sulfate composite fine particles, the transparency of the surface layer is surely attained.

The conductive metal oxide in the barium sulfate composite fine particles is not particularly limited as long as the metal oxide is conductive, and examples thereof may include tin oxide, titanium oxide, zinc oxide, zirconia and indium tin oxide.

A process of attaching the conductive metal oxide as the covering material to barium sulfate as the core material is disclosed in Japanese Patent Application Laid-Open No. 2009-255042.

As the barium sulfate composite fine particles, for example, a commercially available "Passtran-IV" available from MITSUI MINING & SMELTING CO., LTD.) may be used.

It is preferable that the barium sulfate composite fine particles are surface-treated, with a surface treating agent having a polymerizable functional group.

Specifically, it is preferable that the conductive metal oxide constituting the barium sulfate composite fine particles is surface-treated with a surface treating agent having a polymerizable functional group to introduce the polymerizable functional group into the surface of the barium sulfate composite fine particles.

Since the barium sulfate composite fine particles are surface-treated with a surface treating agent having a polymerizable functional group, the film strength of the surface layer can be sufficiently obtained, and the potential stability can be obtained. Therefore, both high durability and high potential characteristics can be achieved. Further, high dispersibility of the barium sulfate composite fine particles in the cured resin can be achieved.

As examples of the polymerizable functional group in the surface treating agent, may be mentioned a vinyl group, an acryloyl group and a methacryloyl group. Such a polymerizable functional group is resided with the polymerizable compound forming the cured resin to form a firm surface layer. It is preferable that the surface treating agent having a polymerizable functional group is a silane coupling agent having a polymerizable functional group seen as a vinyl group, an acryloyl group or a methacryloyl group.

As specific examples of the surface treating agent, may be mentioned the following surface treating agent having an acryloyl group or a methacryloyl group.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2(OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

In addition to the compounds (S-1) to (S-36) exemplified above, a silane compound having a reactive organic group capable of radical-polymerization may be used as the surface treating agent.

The surface treating agents may be used either singly or in a mixture thereof.

The treatment amount of the surface treating agent is 0.1 to 200 parts by mass, more preferably 7 to 70 parts by mass per 100 parts by mass of the barium sulfate composite fine particles.

As an example of the process of treating the barium sulfate composite fine particles with the surface treating agents, may be mentioned a process of wet-cracking a slurry containing barium sulfate composite fine particles and a surface treating agent (suspension of solid particles). This process prevents the reaggregation of the barium sulfate composite fine particles and simultaneously promotes the surface treatment of the barium sulfate composite fine particles. After that, a solvent is removed to obtain a powder.

As an example of a surface treatment device, may be mentioned a wet medium dispersion-type apparatus. The wet medium dispersion-type apparatus is an apparatus performing steps of filling a vessel with beads as a medium, rotating a stirring disk, which is mounted vertically on a rotating shaft, at high speed to crush the barium sulfate composite fine particles and pulverize and disperse the same. The configuration of the device is not limited as long as the barium sulfate composite fine particles can be sufficiently dispersed during the surface treatment for surface-treatment. Apparatuses of various types such as vertical type, horizontal type, continuous type, and batch type may be adopted. Specifically, a sand mill, an Ultra Visco mill, a Perl Mill, a Glen Mill, a DYNO Mill, an agitator mill or a dynamic mill may be used. In these dispersion-type apparatuses, fine pulverization and dispersion are performed by impact crushing, friction, shear and shear stress using pulverizing media such as balls and beads.

As beads used in the wet type medium dispersion-type apparatus, balls made from glass, alumina, zircon, zirconia, steel or flint as a raw material may be used, and balls made from zirconia or zircon are preferable. A bead having a diameter of about 1 to about 2 mm is usually used, but in the present invention, a bead having a diameter of about 0.1 to about 1.0 mm is preferably used.

Various materials such as stainless steel, nylon, and ceramic can be used for the disc or the internal wall of the vessel used in the wet type medium dispersion-type apparatus. In the present invention, the disc or the internal wall of the vessel is preferably made from ceramics such as zirconia or silicon carbide.

In addition to the cured resin and the barium sulfate composite fine particles, the surface layer according to the present invention may contain another component. For example, various antioxidants or various lubricant particles may be contained. Further, fluorine atom-containing resin particles may be contained. It is preferable that the fluorine atom-containing resin particles are one or more appropriately selected from an ethylene tetrafluoride resin, an ethylene chloride trifluoride resin, an ethylene chloride propylene hexafluoride resin, a vinyl fluoride resin, a vinylidene fluoride resin, an ethylene dichloride difluoride resin and copolymers thereof. Among these, an ethylene tetrafluoride resin and a vinylidene fluoride resin are preferable.

The thickness of the surface layer is preferably 0.2 to 10 μm, more preferably 0.5 to 6 μm.

In the photoreceptor having the layer structure (1), a structure other than the surface layer will be described hereinafter.

Conductive Support:

A conductive support constituting the photoreceptor of the present invention is not particularly limited as long as it is conductive, and examples thereof may include a drum- or sheet-shaped metal such as aluminum, copper, chromium, nickel, zinc and stainless steel; a plastic film laminated with a foil of metal such as aluminum and copper; a plastic film deposited with aluminum indium oxide or tin oxide; and a metal, a plastic film and paper which are provided with a conductive layer which is formed by applying a conductive material singly or in combination with a binder resin.

Intermediate Layer:

In the photoreceptor of the present invention, an intermediate layer having a barrier function and an adhesion function may be provided between the conductive support and the photosensitive layer. From the viewpoint of prevention of various failures, if is preferable that an intermediate layer is provided.

For example, such an intermediate layer contains a binder resin (hereinafter may also be referred to as "binder resin for an intermediate layer") and if necessary, conductive particles or metal oxide particles.

As examples of the binder reels for an intermediate layer, may be mentioned casein, polyvinyl alcohol, nitrocellulose, an ethylene-acrylic copolymer, a polyamide resin, a polyurethane resin, and gelatin. Among these, an alcohol-soluble polyamide resin is preferable.

The intermediate layer may contain various conductive particles or metal oxide particles to control the resistance. For example, various particles of metal oxide such as alumina, zinc oxide, titanium oxide, tin oxide, antimony oxide, indium oxide and bismuth oxide can be used. Ultrafine particles of tin-doped indium oxide, antimony-doped tin oxide or zirconium oxide can be used.

The number average primary particle diameter of such metal oxide particles is preferably not larger than 0.3 μm, more preferably not larger than 0.1 μm.

The metal oxide particles may be used either singly or in a mixture thereof. When the metal oxide particles are used in a mixture, the mixture is in the form of solid solution or fusion.

The content of the conductive particles or the metal oxide particles is preferably 50 to 400 parts by mass, more preferably 50 to 350 parts by mass per 100 parts by mass of the binder resin.

The thickness of the intermediate layer is preferably 0.1 to 15 μm, more preferably 0.3 to 10 μm.

Charge Generating Layer:

A charge generating layer in the photosensitive layer constituting the photoreceptor of the present invention contains a charge generating substance and a binder resin (hereinafter may also be referred to as "binder resin for a charge generating layer").

As examples of the charge generating substance, may be mentioned an azo pigment such as Sudan Red and Diane Blue; a quinone pigment such as pyrenequinone and anthoanthrone; a quinocyanine pigment; a perylene pigment; an indigo pigment such as indigo and thioindigo; a polycyclic quinone pigment such as pyranthrone and diphthaloylpyrene; and a phthalocyanine pigment, although it is not limited to these. Among these, a polycyclic quinone pigment and a titanyl phthalocyanine pigment are preferable. The change generating substances may be used either singly or in a mixture thereof.

As the binder resin for a charge generating layer, a publicly known resin can be used. As examples of the binder resin for a charge generating layer, may be mentioned a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a phenolic resin, a polyester resin, an alkyd resin, a polycarbonate resin, a silicone resin, a melamine resin, a copolymer resin containing two or more of these resins (for example, a vinyl chloride-vinyl acetate copolymer resin, and a vinyl chloride-vinyl acetate-maleic anhydride copolymer resin) and a polyvinyl carbazole resin, although it is not limited to these. Among these, a polyvinyl butyral resin is preferable.

The content of the charge generating substance in the charge generating layer is preferably 1 to 600 parts by mass, more preferably 50 to 500 parts by mass per 100 parts by mass of the binder resin for a charge generating layer.

The thickness of the charge generating layer varies according to the characteristics and the content of the charge generating substance and the characteristics and the content of the binder resin for a charge generating layer, and is preferably 0.01 to 5 μm, more preferably 0.05 to 5 μm.

Charge Transporting Layer

A charge transporting layer in the photosensitive layer constituting the photoreceptor of the present invention contains a charge transporting substance and a binder resin, (hereinafter may also be referred to as "binder resin for a charge transporting layer").

The charge transporting substance in the charge transporting layer is a substance for transporting charges (holes). As examples of the charge transporting substance, may be mentioned a triphenylamine derivative, a hydrazone compound, a styryl compound, a benzidine compound and a butadiene compound.

As the binder resin for a charge transporting layer, a publicly known resin can be used. As examples of the tender resin for a charge transporting layer, may be mentioned a polycarbonate resin, a polyacrylate resin, a polyester resin, a polystyrene resin, a styrene-acrylonitrile copolymer resin, a polymethacrylate resin and a styrene-methacrylate copolymer resin. Among these, a polycarbonate resin is preferable. Further, polycarbonate resins of bisphenol A (BPA) type, bisphenol Z (BPZ) type, dimethyl-BPA type and BPA-dimethyl-BPA copolymer type are preferable in terms of cracking resistance, abrasion resistance and charging characteristic.

The content of the charge transporting substance in the charge transporting layer is preferably 10 to 500 parts by mass, more preferably 20 to 250 parts by mass per 100 parts by mass of the binder resin for a charge transporting layer.

The thickness of the charge transporting layer varies according to the characteristics and the content of the charge transporting substance and the characteristics and the content of the binder resin for a charge transporting layer, and is preferably 5 to 40 μm, more preferably 10 to 30 μm.

An antioxidant, an electronic conductive agent, a stabilizer and a silicone oil can be added to the charge transporting layer. Antioxidants disclosed in Japanese Patent Application Laid-Open No. 2000-305201, and electronic conductive agents disclosed in Japanese Patent Application Laid-Open Nos. Sho. 50-137543 and Sho. 58-76483 are preferable.

In the photoreceptor described above, the 10 point average roughness RzJIS of the surface layer in which the barium sulfate composite fine particles are contained in the cured resin falls within a specific range, and the value obtained by the equation n×d falls within a specific range, that is, the number and the size of barium sulfate composite fine particles exposed on the surface layer fall within specific ranges. For this reason, the electrophotographic photoreceptor has high durability and high potential characteristics. Further, even when the cleaning unit such as a blade is used for cleaning, the frictional force between the photoreceptor and the blade or the torque decreases. Therefore, the occurrence of stick-slip and turning up of the blade and the abrasion of the blade can be suppressed.

Production Process of Photoreceptor:

A production process of the photoreceptor of the present invention includes the following steps:

Step (1): applying a coating liquid, for forming an intermediate layer to the circumference surface of a conductive support, and drying the coating liquid to form an intermediate layer;

Step (2): applying a coating liquid for forming a charge generating layer to the circumference surface of the intermediate layer on the conductive support, and drying the coating liquid to form a charge generating layer;

Step (3): applying a coating liquid for forming a charge transporting layer to the circumference surface of the charge generating layer on the intermediate layer, and drying the coating liquid to form a charge transporting layer; and Step (4): applying a coating liquid for forming a surface layer to the circumference surface of the charge transporting layer on the charge generating layer to form a coated film, and curing the coated film to form a surface layer.

Step (1): Formation of Intermediate Layer

The intermediate layer can be formed by dissolving a binder resin for an intermediate layer in a solvent to prepare a coating liquid (hereinafter may also be referred to as "coating liquid for forming an intermediate layer"), dispersing, if necessary, conductive particles or metal oxide particles in the coating liquid, applying the coating liquid to a conductive support in a constant thickness to form a coated film, and drying the coated film.

As a unit for dispersing the conductive particles or the metal oxide particles in the coating liquid for forming an intermediate layer, an ultrasonic disperser, a ball mill, a sand mill or a homomixer can be used, although the unit is not limited to these.

As examples of a process of applying the coating liquid for forming an intermediate layer, may be mentioned a publicly known method such as an immersion coating method, a spray coating method, a spinner coating method, a bead coating method, a blade coating method, a beam coating method, a slide hopper method and a circular slice hopper method.

A method of drying the coated film can be appropriately selected according to the kind or solvent and the film thickness. A heat drying method is preferable.

It is preferable that the solvent used in the step of forming an intermediate layer is one which is capable of well dispersing conductive particles or metal oxide particles, and dissolving a binder resin for an intermediate layer, particularly capable of dissolving a polyamide resin. Specifically, alcohols having 1 to 4 carbon atoms such as methanol, ethanol, n-propyl alcohol, isopropyl alcohol, n-butanol, tert-butanol and sec-butanol are preferable since the solubility of polyamide resin and the supplication performance are excellent. Further, in order to improve the shelf life and the particle dispersibility, an auxiliary solvent which can be used in combination with the solvent and impart excellent effect is used. As examples of such an auxiliary solvent, may be mentioned benzyl alcohol, toluene, methylene chloride, cyclohexanone and tetrahydrofuran.

The concentration of the binder resin for an intermediate layer in the coating liquid for forming an intermediate layer is appropriately selected according to the thickness of the intermediate layer and the production speed.

Step (2): Formation of Charge Generating Layer

The charge generating layer can be formed by dissolving a binder resin for a charge generating layer in a solvent to prepare a solution, dispersing a charge generating substance in the solution to prepare a coating liquid (hereinafter may also be referred to as "coating liquid for forming a charge generating layer"), applying the coating liquid to the intermediate layer in a constant thickness to form coated film, and drying the coated film.

As a unit for dispersing the charge generating substance in the coating liquid for forming a charge generating layer, an ultrasonic disperser, a ball mill, a sand mill, or a homomixer can be used, although the unit is not limited to these.

As examples of a method of applying the coating liquid for forming a charge generating layer, may be mentioned a publicly known method such as an immersion coating method, a spray ousting method, a spinner coating method, a bead coating method, a blade coating method, a beam, coating method, a slide hopper method and a circular slide hopper method.

A method of drying the coated film can be appropriately selected according to the kind of solvent and the film thickness. A heat drying method is preferable.

As examples of the solvent used for forming a charge generating layer, may be mentioned toluene, xylene, methylene chloride, 1,2-dichloroethane, methyl ethyl ketone, cyclohexane, ethyl acetate, tert-butyl acetate, methanol, ethanol, propanol, butanol, methyl cellosolve, 4-methoxy-4-methyl-2-pentanone, ethyl cellosolve, tetrahydrofuran, 1,4-dioxane, 1,3-dioxolane, pyridine and diethylamine, although it is not limited to these.

Step (3): Formation of Charge Transporting Layer

The charge transporting layer can be formed by dissolving a charge transporting substance and a binder resin for a charge transporting layer in a solvent to prepare a coating liquid (hereinafter may also be referred to as "coating liquid for forming a charge transporting layer"), applying the coating liquid to the charge generating layer in a constant thickness to form a coated film, and drying the coated film.

As examples of a method of applying the coating liquid for forming a charge transporting layer, may be mentioned a publicly known method such as an immersion coating method, a spray coating method, a spinner coating method, a bead coating method, a blade coating method, a beam coating method, a slide hopper method and a circular slide hopper method.

A method of drying the coated film can be appropriately selected according to the kind of solvent and the film thickness. A heat drying method is preferable.

As examples of the solvent used for formation of a charge transporting layer, may be mentioned toluene, xylene, methylene chloride, 1,2-dichloroethane, methyl ethyl ketone, cyclohexanone, ethyl acetate, butyl acetate, methanol, ethanol, propanol, butanol, tetrahydrofuran, 1,4-dioxane, 1,3-dioxolane, pyridine and diethylamine, although it is not limited to these.

Step (4): Formation of Surface Layer

The surface layer can be formed by adding a polymerizable compound forming a cured resin, a polymerization initiator, barium sulfate composite fine particles, and if necessary, another component to a publicly known solvent to prepare a coating liquid (hereinafter may also be referred to as "coating liquid for forming a surface layer"), applying the coating liquid for forming a surface layer to the circumference surface of the charge transporting layer formed in the step (3) to form a coated film, drying the coated film, and irradiating the film with actinic radiation such as ultraviolet light and electron beams, thereby performing polymerization reaction of the polymerizable compound in the coated film to cure the film.

When the surface layer is obtained by a reaction of a polymerizable compound or a surface treatment of barium sulfate composite fine particles with a surface treating agent having a polymerizable functional group through coating, drying, and curing steps, a reaction of the polymerizable functional group of the surface treating agent with the polymerizable compound proceeds to form the surface layer as a crosslinked cured resin.

As a unit for dispersing barium sulfate composite fine particles in the coating liquid for forming a surface layer, an ultrasonic disperser, a ball mill, a sand mill, or a homomixer can be used, although the unit is not limited to these.

The 10 point average roughness RzJIS and the peak count of the surface layer can also be controlled by the dispersion time of the barium sulfate composite fine particles.

As the solvent used for forming the surface layer, any solvent which is capable of dissolving or dispersing a polymerizable compound and barium sulfate composite fine particles can be used. As examples of the solvent, may be mentioned methanol, ethanol, n-propyl alcohol, isopropyl alcohol, n-butanol, tert-butanol, sec-butanol, benzyl alcohol, toluene, xylene, methylene chloride, methyl ethyl ketone, cyclohexane, ethyl acetate, butyl acetate, methyl cellosolve, ethyl cellosolve, tetrahydrofuran, 1,4-dioxane, 1,3-dioxolane, pyridine and diethylamine, although it is not limited to these.

As examples of a method of applying the coating liquid for forming a surface layer, may be mentioned a publicly known method such as an immersion coating method, a spray coating method, a spinner coating method, a bead coating method, a blade coating method, a beam coating method, a slide hopper method and a circular slide hopper method.

It is preferable that the coating liquid for forming a surface layer is applied using a circular slide hopper coater.

Hereinafter, a method of applying the coating liquid for forming a surface layer using a circular slide hopper coater will be specifically described.

Figure 2:
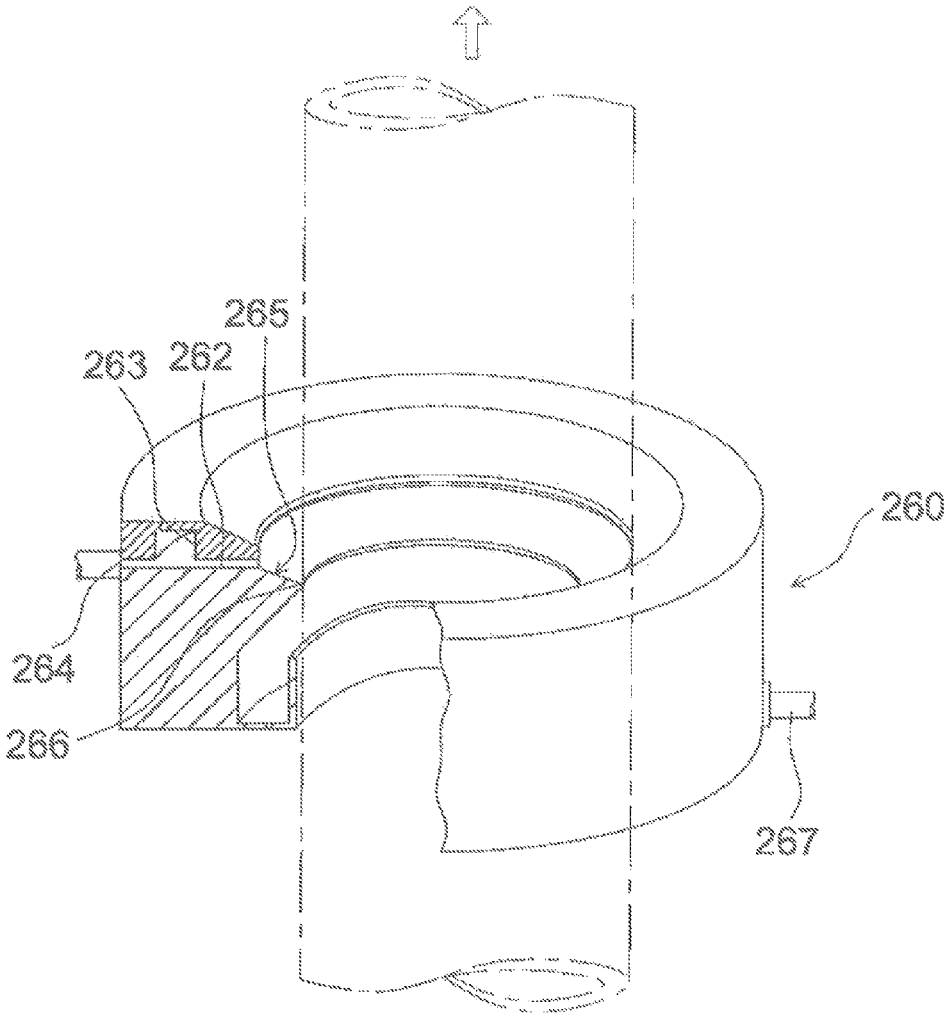
FIG. 2 is a perspective cross-sectional view of the circular slide hopper coater shown in FIG. 1.

As shown in FIGS. 1 and 2, a circular slide hopper coater in classes a cylindrical substrate 251, an annular coating head 260 provided so as to surround the periphery of the substrate 251, and a storage tank 254 for storing a coating liquid L.

The substrate 251 used herein represents a substrate to be coated with a coating liquid, for forming a surface layer, and for example, is in a state in which an intermediate layer and a photosensitive layer are formed on a conductive support (a surface layer is not formed).

The coating head 260 has a narrow coating liquid distribution slit 262 over the whole circumference of the coating head 260 in a direction vertical to the longitudinal direction of the substrate 251. The coating liquid distribution slit 262 has a coating liquid outlet 261 which is an opening on the side of the substrate 251. The coating liquid distribution slit 262 is communicated with an annular coating liquid distribution chamber 263. The coating liquid distribution chamber 263 is provided so as to be supplied with a coating liquid L in the storage tank 254 using a pressure pump 255 via a supply pipe 264.

A slide face 265 is provided below the coating liquid outlet 261 of the coating liquid distribution slit 262 so as to be consecutively sloped downward and terminated, and has a dimension slightly larger than the outer dimension of the substrate 251. A lip-shaped part (bead, solution pooling part) 266 is formed so as to extend downward from the terminal of the slide face 265.

In the circular slide hopper coater, the coating liquid L is extruded through the coating liquid distribution slit 262 during movement of the substrate 251 in an arrow direction, and the coating liquid L is caused to flow along the slide face 265. When the coating liquid L reaches the terminal of the slide face 265, a bead is formed between the terminal of the slide face 265 and the circumference surface of the substrate 231. As a result, the coating liquid L is applied to the surface of the substrate 251 to form, a coated film F. An excess coating liquid L is drained from an outlet 267.

The terminal of the slide face and the substrate are arranged at an interval (about 2 μm to about 2 mm), and accordingly, in a coating process using such a circular slide hopper coater, a coating liquid can be applied without damaging the substrate. Further, even when layers having different properties are formed, a coating liquid can be applied without damaging a previously formed layer. Even when layers which have different properties and can be each dissolved in the same solvent are formed, a time when the layers are present in the solvent during the coating process is much shorter than that during an immersion coating method. Therefore, a coating liquid can be applied without elution of a component of a lower layer toward an upper layer as well as toward a coating bath. For example, a coating liquid can be applied without degradation in the dispersibility of barium sulfate composite fine particles.

The coated film may be subjected to curing treatment without drying. However, it is preferable that the coated film is subjected to curing treatment after air drying or heat drying.

A drying condition can be appropriately selected according to the kind of solvent and the film thickness. The drying temperature is preferably room temperature to 180° C., particularly preferably 80° C. to 140° C. The drying time is preferably 1 minute to 200 minutes, particularly preferably 5 minutes to 100 minutes.

As examples of a reaction method of a polymerizable compound, may be mentioned a reaction method through cleavage by electron beams irradiation, and a reaction method by light or heat through addition of a radical polymerization initiator. As the radical polymerization initiator, any of a photopolymerization initiator and a thermal polymerization initiator can be used. Further, a photopolymerization initiator and a thermal polymerization initiator can be used in combination.

As the radical polymerization initiator, a photopolymerization initiator is preferably used. An alkylphenone-based compound and a phosphine oxide-based compound are preferable, and in particular, a compound having an α-hydroxyacetophenone structure or an acylphosphine oxide structure is preferable.

Specific examples of the acylphosphine oxide compound as the photopolymerization initiator will be described below.

[Chemical Formula 3]

P1

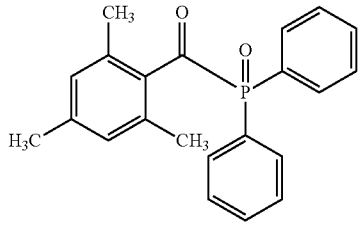

P2

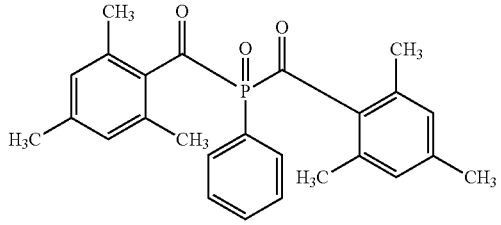

The polymerization initiators may be used either singly or in a mixture thereof.

The amount of the polymerization initiator to be added is preferably 0.1 to 20 parts by mass, more preferably 0.5 to 10 parts by mass per 100 parts by mass of the polymerizable compound.

The coated film is irradiated with actinic radiation for the curing treatment, to generate radicals, resulting in polymerization. Intermolecular and intramolecular crosslink bonds are produced by a crosslinking reaction. Thus, the film is cured to produce a cured resin. It is preferable that the actinic radiation is ultraviolet light or electron beams. Ultraviolet light is particularly preferable since it is easy to use.

Ultraviolet light source can be used without limitation as long as it is a light source which generates ultraviolet light. For example, a low pressure mercury lamp, a medium pressure mercury lamp, a high pressure mercury lamp, a ultra-high pressure mercury lamp, a carbon arc lamp, a metal halide lamp, a xenon lamp or a flash (pulse) xenon lamp can be used.

An exposure condition depends on the individual lamps, and the exposure amount of actinic radiation is preferably 5 to 500 mJ/cm$^2$, more preferably 5 to 100 mJ/cm$^2$.

The power of each of the lamps is preferably 0.1 kW to 5 kW, particularly preferably 0.5 kW to 3 kW.

Electron beam irradiation device as electron beam source is not especially restricted and in general, a curtain beam type device which produces high power at comparatively lower cost is effectively used as an electron beam accelerator for emitting electron beams. The acceleration voltage during irradiation with electron beams is preferably 100 to 300 kV. The absorbed close is preferably 0.5 to 10 Mrad.

The irradiation time to get a required dose of actinic radiation is preferably 0.1 seconds to 10 minutes, more preferably 0.1 seconds to 5 minutes from the viewpoint of operation efficiency.

In the step of forming the surface layer, the coated film can be dried before, during, and after irradiation with actinic radiation. A timing for drying may be appropriately selected from before, during, after the irradiation, and a combination thereof.

Image Forming Apparatus:

The image forming apparatus of the present invention includes a photoreceptor, a charging unit for charging the surface of the photoreceptor, an exposure unit for forming an electrostatic latent image on the surface of the photoreceptor, a developing unit for developing the electrostatic latent image with a toner to form a toner image, a transfer unit for transferring the toner image to a transfer material, a fixing unit for fixing the toner image transferred to the transfer material, and a cleaning unit for removing a residual toner on the photoreceptor, wherein the photoreceptor of the present invention is used as the photoreceptor. It is preferable that the cleaning unit is a blade of which the leading edge is in contact with the photoreceptor and scratches the surface of the photoreceptor.

Figure 3:
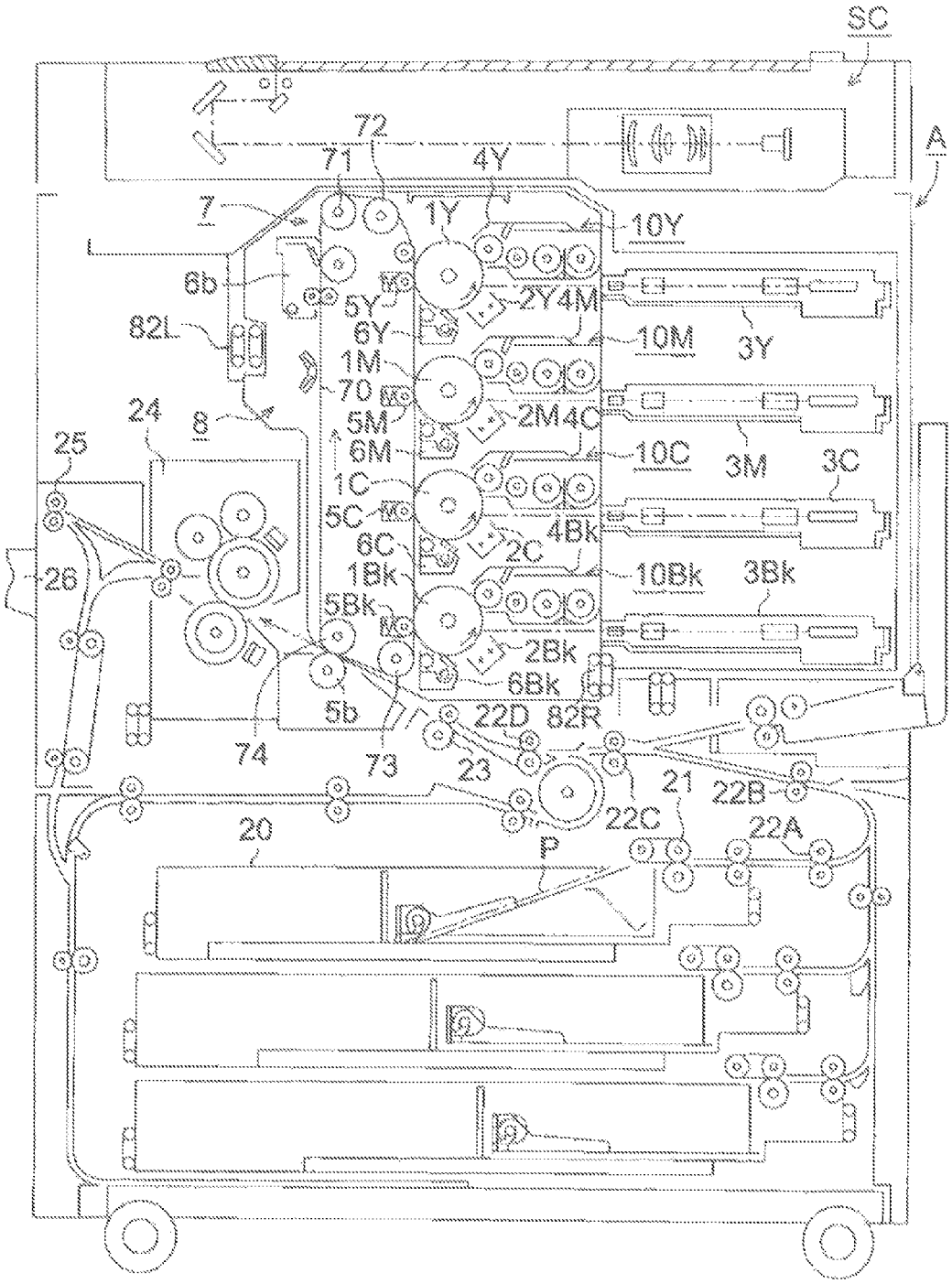
FIG. 3 is a cross-sectional view illustrating the configuration of one example of an image forming apparatus of the present invention.

FIG. 3 is a cross-sectional view illustrating the configuration, of one example of the image forming apparatus of the present invention.

The image forming apparatus is referred to as a tandem type color image forming apparatus, and includes four sets of image forming sections (image forming units) 10Y, 10M, 10C and 10Bk, an endless belt-shaped intermediate transfer body unit 7, a paper feed unit 21, and a fixing unit 24, above an image forming apparatus main body A, a manuscript image residing device SC is disposed.

The image forming section 10Y forming a yellow image has a charging unit 2Y, an exposure unit 3Y, a developing unit 4Y, a primary transfer roller 5Y as a primary transfer unit, and a cleaning unit 6Y, which are disposed in the periphery of a drum-shaped photoreceptor 1Y. The image forming section 10M forming a magenta image has a drum-shaped photoreceptor 1M, a charging unit 2M, an exposure unit 3M, a developing unit 4M, a primary transfer roller 5M as the primary transfer unit and a cleaning unit 6M. The image forming section 10C forming a cyan image has a drum-shaped photoreceptor 1C, a charging unit 2C, an exposure unit 3C, a developing unit 4C, a primary transfer roller 5C as the primary transfer unit and a cleaning unit 6C. The image forming section 10Bk forming a black image has a drum-shaped photoreceptor 1Bk, a charging unit 2Bk, an exposure unit 3Bk, a developing unit 4Bk, a primary transfer roller 5Bk as the primary transfer unit surf a cleaning unit 6Bk. In the image forming apparatus of the present invention, the photoreceptor of the present invention is used as the photoreceptors 1Y, 1M, 1C, and 1Bk. As described above, the photoreceptor of the present invention has high durability and high potential characteristics. Further, even when the cleaning unit such as a blade is used for cleaning, the frictional force between the photoreceptor and the blade or the torque decreases. Therefore, the occurrence of stick-slip and turning up of the blade and the abrasion of the blade can be suppressed.

The four sets of the image forming units 10Y, 10M, 10C and 10Bk include: the photoreceptors 1Y, 1M, 1C and 1Bk; the charging units 2Y, 2M, 2C and 2Bk; the exposure units 3Y, 3M, 3C and 3Bk; the developing units 4Y, 4M, 4C and 4Bk, which are rotatable; and the cleaning units 6Y, 6M, 6C and 6Bk for cleaning the photoreceptors 1Y, 1M, 1C and 1Bk, respectively.

The image forming units 10Y, 10M, 10C and 10Bk are different in the color of toner image each formed in the photoreceptors 1Y, 1M, 1C and 1Bk, but are the same in the configuration. The configuration will be described in detail with reference to the image forming unit 10Y.

In the image forming unit 10Y, the charging unit 2Y, the exposure unit 3Y, the developing unit 4Y and the cleaning unit 6Y are disposed around the photoreceptor 1Y serving as an image forming body, and a toner image of yellow (Y) is formed. In the present embodiment, at least the photoreceptor 1Y, the charging unit 2Y, the developing unit 4Y and the cleaning unit 6Y in the image forming unit 10Y are integrated into a single unit.

The charging unit 2Y is a unit for providing a uniform potential to the photoreceptor 1Y. In the embodiment, a corona discharge type charger is used for the photoreceptor 1Y.

The exposure unit 3Y is a unit for exposing the photoreceptor 1Y having a uniform potential provided by the charging unit 2Y to light based on (yellow) image signals to form an electrostatic latent image corresponding to a yellow image. As the exposure unit 3Y, an exposure unit including an LED arraying light-emitting elements in the axial direction of the photoreceptor 1Y and an imaging element, or a laser optical system is used.

For example, the developing unit 4Y includes a development sleeve which is equipped with a magnet and is rotated while a developer is held and a voltage-applying device which applies direct current and/or alternating current bias voltage between the photoreceptor and the development sleeve.

As examples of the fixing unit 24, may be mentioned a heat roller type fixing unit including a heating roller equipped with a heat source thereinside and a pressure roller provided, so as to be pressed against and in contact with the heating roller to form a fixing nip portion.

The cleaning unit 6Y includes a cleaning blade and a brush roller located upstream of the cleaning blade.

Figure 4:
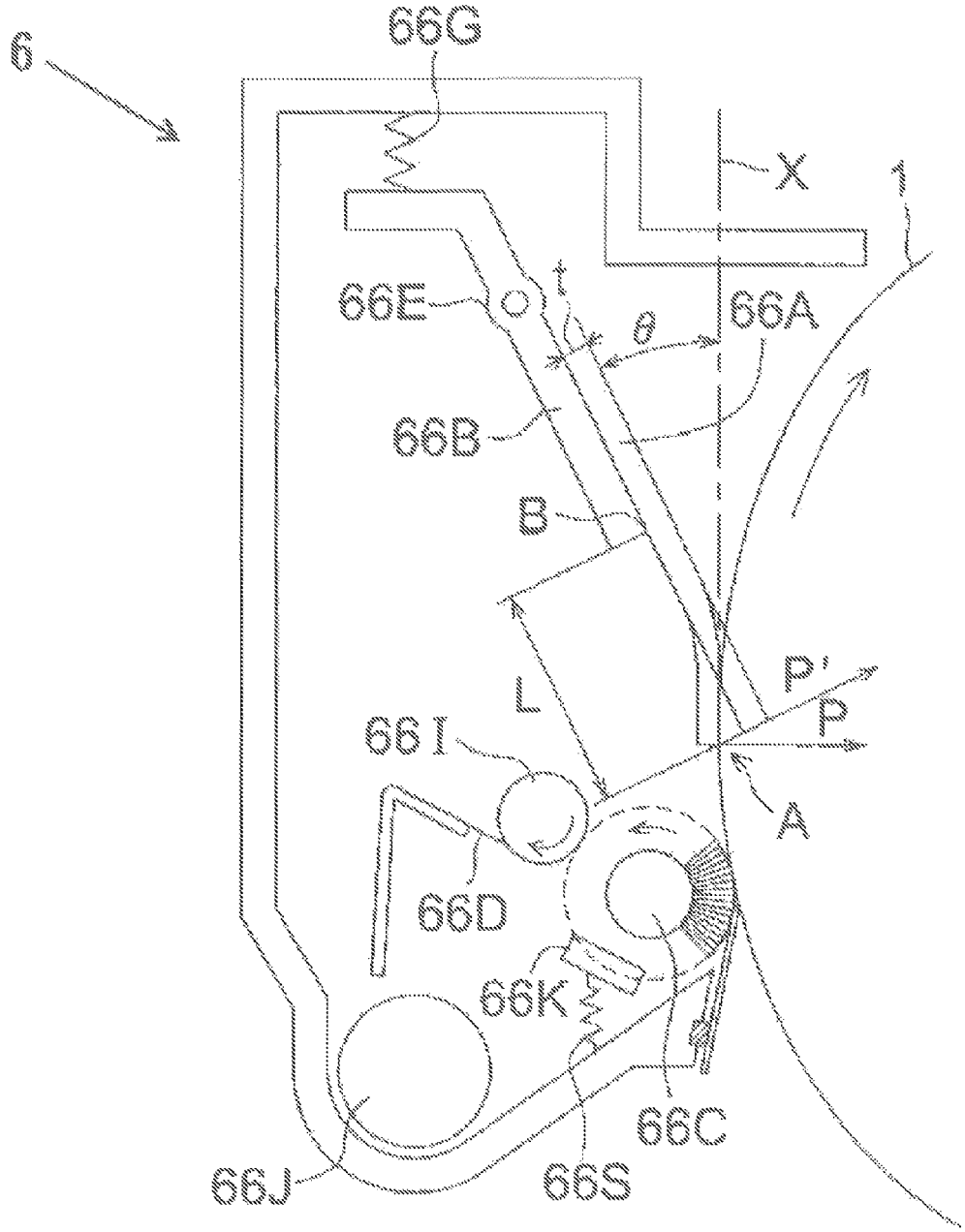
FIG. 4 is a cross-sectional view illustrating the configuration of one example of a cleaning unit in the image forming apparatus of the present invention.

As shown in FIG. 4, specifically, the cleaning unit 6 includes a cleaning blade 66A which is disposed so that the leading edge is in contact with the surface of a photoreceptor 1 and a brush roller 66C which is located upstream of the cleaning blade and comes into contact with the surface of the photoreceptor 1.

The cleaning blade 66A has a function of removing a residual toner attached to the photoreceptor 1 and a function of scratching the surface of the photoreceptor 1.

The cleaning blade 66A is supported by a supporting member 66B. As a material for the cleaning blade 66A, a rubber elastic body is used as such a material, a urethane rubber, a silicon rubber, a fluororubber, a chloroprene rubber and a butadiene rubber are known. Among these, a urethane rubber is particularly preferable since the abrasion characteristic thereof is excellent as compared with other rubbers.

The supporting member 66B is made of a plate-shaped metal member or plastic member. As the metal member, may be mentioned a stainless steel plate, an aluminum plate and a vibration-control steel plate.

In the present invention, it is preferable that the leading edge of the cleaning blade 66A is in contact with the surface of the photoreceptor 1 with a load applied in a direction (counter direction) opposite to the rotation direction of the photoreceptor 1. As sheen in FIG. 4, it is preferable that a contact surface is formed when the leading edge of the cleaning blade 66A is in contact with the photoreceptor 1.

A contact load P and a contact angle θ of the cleaning blade 66A with respect to the photoreceptor 1 are preferably 2 to 40 N/m and 5 to 35°, respectively.

The contact load P is a vector value in the normal direction of a contact force P' when the cleaning blade 66A is in contact with the drum-shaped photoreceptor 1.

The contact angle θ represents an angle of the blade before deformation with respect to a tangent line X on a contact point A of the photoreceptor 1.

A reference symbol 66E represents a rotation axis capable of rotating the supporting member 66B and a reference symbol 66G represents a load spring.

A free length L is preferably 6 to 15 mm.

As shown in FIG. 4, the free length L of the cleaning blade 66A represents a length between the end part B of the supporting member 66B and the leading edge of the cleaning blade 66A before deformation.

The thickness t of the cleaning blade 66A is preferably 0.5 to 10 mm.

As shown in FIG. 4, the thickness t of the cleaning blade 66A represents a length in a direction vertical to the contact surface of the supporting member 66B.

The brush roller 66C has a function of removing a residual toner attached to the photoreceptor 1 and collecting a residual toner removed by the cleaning blade 66A and a function of scratching the surface of the photoreceptor 1. Specifically, the brush roller 66C comes into contact with the surface of the photoreceptor 1, and the contact portion of the brush roller is rotated in the same direction as the travel direction of the photoreceptor 1. Thus, the residual toner and paper dust on the photoreceptor 1 are removed. In addition, the residual toner removed by the cleaning blade 66A is conveyed and collected in a conveyance screw 66J by the brush roller 66C. Further, the surface of the photoreceptor 1 is sliced off and refreshed.

It is preferable that a flicker 66I as a removing unit is brought into contact with the brush roller 66C to remove a substance to be removed such as the residual toner transferred from the photoreceptor 1 to the brush roller 66C. Further, a toner attached to the flicker 66I is removed by a scraper 66D, and collected in the conveyance screw 66J. The collected toner is discharged outside as a waste material so: conveyed through a recycle pipe (not shown) for toner recycle to a developing devise and reused.

As the flicker 66I, a metal pipe made of stainless steel or aluminum is preferably used.

As the scraper 66D, an elastic plate such as a phosphor bronze plate, a polyethylene terephthalate plate or a polycarbonate plate is preferably used. It is preferable that the scraper 66D is provided so that the leading edge thereof is in contact with the flicker 66I by a counter method in which the leading edge forms an acute angle with respect to the rotation direction of the flicker 66I.

A solid material 66K of an antioxidant (solid material made of an antioxidant, zinc stearate and the like) is attached to a load spring 66S so as to be pressed to the brush roller 66C by the load spring 66S. While the brash roller 66C is rotated, the solid material 66K of the antioxidant is scratched, whereby the antioxidant is supplied to the surface of the photoreceptor 1.

As the brush roller 66C, a conductive or semiconductive brush roller is used. As a material for a brush, of the brush roller 66C, any material can be used. As the material, a fiber forming macromolecular polymer having hydrophobicity and high dielectric constant is preferably used. As examples of the macromolecular polymer, may be mentioned rayon, nylon, polycarbonate, polyester, a methacrylate resin, an acrylic resin, polyvinyl chloride, polyvinylidene chloride, polyproprylene, polystyrene, polyvinyl acetate, a styrene-butadiene copolymer, a vinylidene chloride-acrylonitrile copolymer, a vinyl chloride-vinyl, acetate copolymer, a vinyl chloride-vinyl acetate-maleic anhydride copolymer, a silicone resin, a silicone-alkyd resin, a phenolformaldehyde resin, a styrene-alkyd resin and polyvinyl acetal (for example, polyvinyl butyral). These resins may be used either singly or in a mixture thereof. Among these, rayon, nylon, polyester, an acrylic resin and polypropylene are preferable.

For the brush roller 66C, a conductive or semiconductive material can also be used. Further, as the material, a material in which the specific resistance is adjusted to an optional value by addition of a low-resistant substance such as carbon, can be used.

The fineness of each brush bristle of the brush in the brush roller 66C is preferably 5 to 20 D. When the fineness is less than 5 D, the scratching force is not sufficient, and therefore the substance attached to the surface cannot be removed. In contrast, when the fineness is more than 20 D, the brush as rigid. Therefore, the surface of the photoreceptor 1 is damaged and worn, and the life of the photoreceptor 1 is shortened.

"Denier (D)" represents the mass, expressed in grams, of a brush bristle (fiber) in the brush roller 66C per length of 9,000 m.

The brush bristle density of the brush roller 66C (the number of brush bristle per square inch) is $4.5\times10^2/cm^2$ to $2.0\times10^4/cm^2$.

When the brush bristle density is less than $4.5\times10^2/cm^2$, the degree of rigidity is low and the scratching force is low. Further, the photoreceptor cannot be uniformly scratched and the attached substance cannot be uniformly removed. When the brush bristle density is more than $2.0\times10^2/cm^2$, the brush is rigid and the scratching force is high. Therefore, the photoreceptor 1 is excessively worn and a failure such as fog caused by a decrease in sensitivity and black streak caused by a crack is generated on an image.

The degree of the brush roller 66C dug into the photoreceptor 1 is preferably set to 0.4 to 1.5 mm.

The degree of the dug brush roller 66C means a load applied to the brush roller 66C by the relative movement between the photoreceptor 1 drum and the brush roller 66C. This load corresponds to a scratching force applied by the brush roller 66C as seen from the photoreceptor 1 drum. The definition of a range of the load means that the photoreceptor 1 should be scratched at a moderate force.

The degree of the dug brush roller represents the length of the dug brush roller when the brush bristle is linearly dug into the photoreceptor 1 without bending during contact of the brush roller 66C with the photoreceptor 1.

As a core material of a roller used in the brush roller 66C, metal such as stainless steel and aluminum, paper or plastic is mainly used, although the core material is not limited to these.

It is preferable that the brush roller 660 is rotated so that the contact portion moves in the same direction as in the surface of the photoreceptor 1. When excess toner is present on the surface of the photoreceptor 1, a toner removed by the brush roller 66C may drop by the movement, of the contact portion in a reverse direction, and as a result, a record paper and a device may be contaminated.

When the photoreceptor a and the crush roller 66C move in the same direction, the surface speed ratio thereof preferably falls within a range of 1:1.1 to 1:2.

The image forming apparatus of the present invention may be configured, so that the above described photoreceptor and constituent elements such as a developing unit and a cleaning unit are combined into an integrated unit as a process cartridge (image forming unit), and then this image forming unit may be constituted so as to be detachable to the apparatus main body. Further, a process cartridge (image forming unit) may be provided so as to hold at least one of a charging unit, an exposure unit, a developing unit, a transfer unit and a cleaning unit together with the photoreceptor as an integrated unit. Thus, a single image forming unit detachable to the apparatus main body is provided. The single image forming unit may be detachable using a guide unit such as a rail of the apparatus main body.

The endless belt-shaped intermediate transfer body unit 7 is wound by a plurality of rollers, and has an endless belt-shaped intermediate transfer body 70 as a semiconductive endless belt-shaped second image carrier which is rotatably supported.

Each of the color images formed by the image forming units 10Y, 10M, 10C and 10Bk is successively transferred to the rotating endless belt-shaped intermediate transfer body 70 by the primary transfer rollers 5Y, 5M, 5C and 5Bk as primary transfer units to form a synthetic color image. A transfer material P (image support supporting a final image fixed, for example, plain paper and transparent sheet) housed in a paper feed cassette 20 is fed by the paper feed unit 21 and conveyed to a secondary transfer roller 5*b* as a second transfer unit through a plurality of intermediate rollers 22A, 22B, 22C, and 22D and a resist roller 23, and color images are secondarily transferred together to the transfer material P. The transfer material P to which the color images have been transferred is fixed by the fixing unit 24, nipped by output paper rollers 25, and put onto an output paper tray 26 outside the apparatus. Herein, a transfer support of a corner image formed on the photoreceptor, such as an intermediate transfer body and a transfer material is collectively referred to as a transfer medium.

After the color images are transferred to the transfer material P by the secondary transfer roller 5*b* as the secondary transfer unit, a residual toner is removed from the endless belt-shaped intermediate transfer body 70, in which the transfer material P is curvature-separated, by a cleaning unit 6*b*.

During image formation processing, the primary transfer roller 5Bk is always in contact with the photoreceptor 1Bk. Only during color image formation, the other primary transfer rollers 5Y, 5M and 5C are brought into contact with the photoreceptors 1Y, 1M and 1C, respectively.

Only when the transfer material P passes through the secondary transfer roller 5*b* for secondary transfer, the secondary transfer roller 5*b* is brought into contact with the endless belt-shaped intermediate transfer body 70.

Further, a housing 8 is constituted, so as to be withdrawn from the apparatus main body P through supporting rails 82L and 82R.

The housing 8 contains the image forming sections 10Y, 10M, 10C and 10Bk, and the endless belt-shaped intermediate transfer body unit 7.

The image forming sections 10Y, 10M, 10C and 10Bk are tandemly arranged in the vertical direction. The endless belt-shaped intermediate transfer body unit 7 is disposed on the left side of the photoreceptors 1Y, 1M, 1C and 1Bk as shown in the drawing. The endless belt-shaped intermediate transfer body unit 7 includes the rotatable endless belt-shaped intermediate transfer body 70 wound around rollers 71, 72, 73 and 74, the primary transfer rollers 5Y, 5M, 5C and 5Bk, and the cleaning unit 6*b*.

The image forming apparatus shown in FIG. 3 is a color laser printer, but the embodiment is similarly applicable to a monochrome laser printer and a copier. Further, a light source other than a laser, for example, an LSD light source may also be used as the exposure light source.

According to the image forming apparatus, a high-quality image can be formed over a long period of time since the apparatus includes the photoreceptor of the present invention.

EXAMPLES

Hereinafter, the present invention will be described in detail by way of Examples, but the present invention is not limited to the Examples. Herein, "part(s)" in the following description represents "part(s) by mass."

Production Example 1 of Photoreceptor

The surface of an aluminum cylinder having a diameter of 60 mm was machined to produce a conductive support [1] with a finely roughened surface.

Formation of Intermediate Layer:

A dispersion of a composition described below was diluted twice with the same solvent as described below, allowed to stand overnight, and filtered through a filter (Rigimesh 5 μm filter, manufactured by Nihon Pall Ltd.) to obtain a coating liquid [1] for formation of an intermediate layer.

Binder resin: polyamide resin "CM8000" (available from TORAY INDUSTRIES, INC.) 1 part Metal oxide particles: titanium oxide "SMT600SAS" (available from Tayca Corporation) 3 parts Solvent: methanol 10 parts A sand mill was used as a disperses for 10-hour dispersion in batch.

The coating liquid [1] for forming an intermediate layer was applied to the conductive support [1] by an immersion coating method to form an intermediate layer [1] saving a dried thickness of 2 μm.

Formation of Charge Generating Layer:

20 Parts of a pigment (CG-1) described below as a charge generating substance, 10 parts of polyvinyl butyral resin "#6000-C" (available from DENKI KAGAKU KOGYO KABUSHIKI KAISHA) as a binder resin, 700 parts of term-butyl acetate as a solvent and 300 parts of 4-methoxy-4-methyl-2-pentanone as another solvent were mixed, and dispersed using a sand mill for 10 hours, to prepare a coating liquid [1] for forming a charge generating layer. The coating liquid [1] for forming a charge generating layer was applied to the intermediate layer [1] by an immersion coating method to forma charge generating layer [1] having a dried thickness of 0.3 μm.

Synthesis of Pigment (CG-1):

(1) Synthesis of Amorphous Titanyl Phthalocyanine:

23.3 parts of 1,3-diiminoisoindoline was dispersed in 200 parts of o-dichlorobenzene. 20.4 parts of titanium tetra-n-butoxide was added thereto, and the mixture was heated at 150 to 160° under a nitrogen atmosphere for 5 hours. After cooling in air, the precipitated crystal was collected by filtration, washed with chloroform, a 2% hydrochloric acid aqueous solution, water, and methanol, in this order, and dried to obtain 26.2 parts (yield: 91%) of crude titanyl phthalocyanine.

Subsequently, the crude titanyl phthalocyanine was dissolved in 250 parts of concentrated sulfuric acid under stirring at 5° C. or lower for 1 hour, and the solution was poured in 5,000 parts of water at 20° C. The precipitated crystal was collected by filtration, and sufficiently washed with water to obtain 225 parts of a wet paste product.

The wet paste product was frozen in a freezer and then thawed, followed by filtration and drying, to obtain 24.8 parts (yield: 86%) of amorphous titanyl phthalocyanine.

(2) Synthesis of Adduct of (2R,3R)-2,3-Butanediol and Titanyl Phthalocyanine (CG-1):

10.0 parts of the above-described amorphous titanyl phthalocyanine and 0.94 parts (0.6 equivalent ratio) (the equivalent ratio is an equivalent ratio relative to the titanyl phthalocyanine, which is the same hereinafter) of (2R,3R)-2,3-butanediol were mixed in 200 parts of ortho-chlorobenzene (ODB), and then stirred under heating at 60 to 70° C. for 6.0 hours. After standing overnight, methanol was added to the reaction mixture to produce a crystal. The crystal was collected by filtration, and washed with methanol to obtain 10.3 parts of CG-1 (pigment containing an adduct of (2R,3R)-2,3-dutanediol and titanyl phthalocyanine). In the X-ray diffraction spectrum of the pigment (CG-1), clear peaks appeared at 8.3°, 24.7°, 25.1° and 26.5°. In the mass spectrum, peaks appeared at 576 and 648. In the IR spectrum, both absorptions of Ti═O and O—Ti—O appeared in the vicinity of 970 $cm^{-1}$ and 630 $cm^{-1}$, respectively. Further, in the thermal analysis (TG), a mass decrease of about 7% was observed at 390 to 410° C. Therefore, the pigment was presumed to be a mixture of a 1:1 adduct or titanyl phthalocyanine and (2R,3R)-2,3-butanediol and a non-adduct (non-added) titanyl phthalocyanine.

The BET specific surface area of the obtained pigment (CG-1) was measured using an automatic fluid-type specific surface area analyzer (Micrometrics FlowSorb type, manufactured by Shimadzu Corp.) to be 31.2 $m^2/g$.

Formation of Charge Transporting Layer:

223 Parts of a compound A described below as a charge transporting substance, 300 parts of polycarbonate resin "Z300" (available from MITSUBISHI GAS CHEMICAL COMPANY, INC.) as a binder resin, 6 parts of "Irganox 1010" (available from Nihon Ciba-Geigy K.K.) as an antioxidant, 1,600 parts of tetrahydrofuran (THF) as a solvent and 400 parts of toluene and 1 part of silicone oil "KF-50" (available from Shin-Etsu Chemical Co., Ltd.) as another solvent were mixed and dissolved to prepare a coating liquid [1] for forming a charge transporting layer.

The coating liquid [1] for forming a charge transporting layer was applied to the charge generating layer [1] by a circular slide hopper coater to form a charge transporting layer [1] having a dried thickness of 20 μm.

[Chemical Formula 4]

Compound A

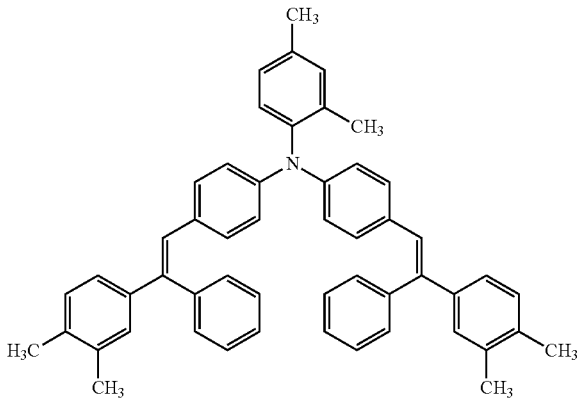

Formation of Surface Layer:

(1) Production of Barium Sulfate Composite Fine Particles:

Barium sulfate composite fine particles "Passtran-IV" (available from MITSUI MINING & SMELTING CO. LTD., number average primary particle diameter (d): 200 nm) in which tin oxide was adhered to the surface of a core material made of barium sulfate was subjected to a surface treatment with the compound (S-15) exemplified above as a surface treating agent, as described below, to produce barium sulfate composite fine particles [1].

A mixture of 100 parts of barium sulfate composite fine particles to which tin oxide was adhered, 30 parts of the compound (S-15) ($CH_2{=}C(CH_3)COO(CH_2)_3Si(OCH_3)_3$) as a surface treating agent and 300 parts of mixed solvent of toluene and isopropyl alcohol at a mass ratio of 1:1 and zirconia beads were placed in a sand mill, and stirred at about 40° C. and a rotation speed of 1,500 rpm. Thus, surface treatment was performed. Subsequently, the treated mixture was taken out, placed in a Henschel mixer, and stirred at a rotation speed of 1,500 rpm for 15 minutes. The mixture was then dried at 120° C. for 3 hours to complete the surface treatment. As a result, surface-treated barium sulfate composite fine particles [1] were obtained.

(2) Formation of Surface Layer:

80 Parts of the surface-treated barium sulfate composite fine particles [1], 100 parts of the exemplified compound (M1) as a polymerizable compound, 320 parts of 2-butanol as a solvent, and 80 parts of tetrahydrofuran as another solvent were mixed in a dark place, and dispersed using a sand mill as a disperser for 5 hours. To the mixture, 10 parts of the compound (P2) as a polymerization initiator was added, and dissolved under stirring in a dark place, to prepare a coating liquid [1] for forming a surface layer. The coating liquid [1] for forming a surface layer was applied to the charge transporting layer [1] by a circular slide hopper coater to form a coated film. The film was irradiated with ultraviolet light using a metal halide lamp for 1 minute to produce a photoreceptor [1] including a surface layer [1] having a dried thickness of 5.0 μm.

In the surface profile of the photoreceptor [1], the 10 point average roughness RzJIS of the surface layer was 0.5 μm and the peak count (n) of the surface layer was 150.

Production Examples 2 to 7 and 9 to 13 of Photoreceptor

Photoreceptors [2] to [7] and [9] to [13] were each produced in the same manner as in Formation of surface layer in Production Example 1 of photoreceptor except that the kind and the addition amount of barium sulfate composite fine particles, and the kind of surface treating agent were changed into those shown in Table 1.

Production Example 8 of Photoreceptor

A photoreceptor [8] was produced in the same manner as in Formation of surface layer in Production Example 1 of Photoreceptor except that the surface-treated barium sulfate composite fine particles [1] were changed into barium sulfate composite fine particles [8] not surface-treated ("Passtran-IV" (available from MITSUI MINING & SMELTING CO., LTD., number average primary particle diameter (d): 200 nm)) and the dispersion time using a sand mill was changed into 10 hours.

Production Example 14 of Photoreceptor

A photoreceptor [14] was produced in the same manner as in formation of surface layer in Production Example 1 of photoreceptor except that the addition amount of the surface-treated barium sulfate composite fine particles was changed into 50 parts, and the dispersion time using a sand mill was changed into 10 hours.

Production Example 15 of Photoreceptor

A photoreceptor [15] was produced in the same manner as in formation of surface layer in Production Example 1 of photoreceptor except that the addition amount of the surface-treated barium sulfate composite fine particles was changed into 150 parts, and the dispersion time using a sand mill was changed into 2 hours.

TABLE 1

| | Surface layer | | | | | | | | |
|---|---|---|---|---|---|---|---|---|---|
| | Barium sulfate composite fine particles | | | | | | | | |
| Photoreceptor No. | No. | Core material | Covering material | Number average primary particle diameter (d) (nm) | Surface treating agent | Addition amount (part by mass) | Pc(n) (Number per length of 8 mm) | n × d (pieces * nm) | RzJIS (μm) |
| (1) | (1) | Barium sulfate | $SnO_2$ | 200 | S-15 | 80 | 150 | 30000 | 0.5 |
| (2) | (2) | Barium sulfate | $TiO_2$ | 200 | S-15 | 80 | 183 | 36600 | 0.5 |
| (3) | (3) | Barium sulfate | $SnO_2$ | 50 | S-15 | 80 | 210 | 10500 | 0.5 |
| (4) | (4) | Barium sulfate | $SnO_2$ | 500 | S-15 | 80 | 398 | 199000 | 0.5 |
| (5) | (1) | Barium sulfate | $SnO_2$ | 200 | S-15 | 50 | 96 | 19200 | 0.2 |
| (6) | (1) | Barium sulfate | $SnO_2$ | 200 | S-15 | 150 | 513 | 102600 | 1.5 |
| (7) | (7) | Barium sulfate | $SnO_2$ | 200 | S-5 | 80 | 151 | 30200 | 0.5 |

TABLE 1-continued

| Photoreceptor No. | Surface layer: Barium sulfate composite fine particles: No. | Core material | Covering material | Number average primary particle diameter (d) (nm) | Surface treating agent | Addition amount (part by mass) | Pc(n) (Number per length of 8 mm) | n × d (pieces * nm) | RzJIS (μm) |
|---|---|---|---|---|---|---|---|---|---|
| (8) | (8) | Barium sulfate | $SnO_2$ | 200 | — | 80 | 781 | 156200 | 1.3 |
| (9) | (9) | $SnO_2$ | — | 20 | S-15 | 80 | 54 | 1080 | 0.3 |
| (10) | (10) | $TiO_2$ | $SnO_2$ | 200 | S-15 | 80 | 146 | 29200 | 0.5 |
| (11) | (11) | Barium sulfate | — | 200 | S-15 | 80 | 156 | 31200 | 0.5 |
| (12) | (12) | Barium sulfate | $SnO_2$ | 20 | S-15 | 80 | 130 | 2600 | 0.2 |
| (13) | (13) | Barium sulfate | $SnO_2$ | 1000 | S-15 | 80 | 251 | 251000 | 1.0 |
| (14) | (1) | Barium sulfate | $SnO_2$ | 200 | S-15 | 50 | 43 | 8600 | 0.1 |
| (15) | (1) | Barium sulfate | $SnO_2$ | 200 | S-15 | 150 | 878 | 175600 | 2.0 |

※[Pc]→Prak count

Examples 1 to 8 and Comparative Examples 1 to 7

Each of the photoreceptors [1] to [15] was mounted in an apparatus for evaluation "bizhub PRO C6501" (manufactured by Konica Minolta Business Technologies, Inc.) which had basically the same configuration as in the image forming apparatus shown in FIG. 3, and evaluated. As an exposure light source of the apparatus "bizhub PRO C6501," a semiconductor laser with a wavelength of 380 nm was used.

An endurance test was carried out as follows. A character image with an image ratio of 6% was continuously printed on both sides of 300,000 sheets by A4 long-edge feed under a high-temperature and high-humidity environment of 30° C. and 85%. The abrasion resistance, potential stability end cleaning property of each of the photoreceptors were evaluated.

(1) Evaluation of Abrasion Resistance

The abrasion resistance was evaluated from the amount of decrease in the thickness of a surface layer of a photoreceptor before and after the endurance test.

Specifically, the thickness of the surface layer was measured at random 10 points of a uniform thickness portion (where thickness fluctuation portions at the beginning and the end of coating were excluded based on a thickness profile produced in advance). The average of the thickness was defined as the thickness of the surface layer. A difference between the thickness of the surface layer before and after the endurance test was calculated as the amount (μm) of decrease in the thickness using an eddy current type thickness measurement device "EDDY560C" (manufactured by HELMUT FISHER GMBTE CO.) as a layer thickness measurement device. When the amount of decrease in the thickness of a photoreceptor is less than 4 μm, the photoreceptor is evaluated to be practical.

(2) Evaluation of Potential Stability

The potential stability was evaluated from the variation of potential at an exposed portion of a photoreceptor before and after the endurance test.

Specifically, the initial charge potential was adjusted to 600±50 V, and the amount (ΔV) of change in the potential at the exposed portion before the endurance test and after printing 300,000 sheets was calculated. When the amount of change in the potential at the exposed portion is not more than 100 V, the photoreceptor is evaluated to be practical.

(3) Evaluation of Cleaning Property

The cleaning property was evaluated from the abrasion width of a cleaning blade before and after the endurance test. When the abrasion, width of a blade is less than 30 μm, a photoreceptor is evaluated to be practical.

TABLE 2

| | Photoreceptor No. | Evaluation: Abrasion resistance (μm) | Potential stability (ΔV) | Cleaning property (μm) |
|---|---|---|---|---|
| Example1 | [1] | 2.0 | 40 | 15 |
| Example2 | [2] | 3.5 | 22 | 20 |
| Example3 | [3] | 1.5 | 67 | 27 |
| Example4 | [4] | 3.0 | 22 | 20 |
| Example5 | [5] | 1.7 | 70 | 25 |
| Example6 | [6] | 3.8 | 25 | 28 |
| Example7 | [7] | 1.5 | 75 | 25 |
| Example8 | [8] | 3.6 | 17 | 29 |
| Comparative Example1 | [9] | 2.0 | 23 | 50 |
| Comparative Example2 | [10] | 5.8 | 15 | 30 |
| Comparative Example3 | [11] | 3.2 | 130 | 24 |
| Comparative Example4 | [12] | 5.5 | 80 | 40 |
| Comparative Example5 | [13] | 4.0 | 20 | 35 |
| Comparative Example6 | [14] | 1.9 | 50 | 45 |
| Comparative Example7 | [15] | 4.0 | 20 | 55 |

REFERENCE SIGNS LIST

1, 1Y, 1M, 1C, 1Bk Photoreceptor
2Y, 2M, 2C, 2Bk Charging unit
3Y, 3M, 3C, 3Bk Exposure unit
4Y, 4M, 4C, 4Bk Developing unit.
5Y, 5M, 5C, 5Bk Primary transfer roller
5*b* Secondary transfer roller
6, 6Y, 6M, 6C, 6Bk, 6*b* Cleaning unit
7 Intermediate transfer body suit
8 Housing
10Y, 10M, 10C, 10Bk Image forming unit
21 Paper feed unit
20 Paper feed cassette
22A, 22B, 22C, 22D Intermediate roller
23 Resist roller
24 Fixing unit
25 Output paper roller

26 Output paper tray
66A Cleaning blade
66B Supporting member
66C brash roller
66D Scraper
66E Rotation axis
66G Load spring
66I Flicker
66J Conveyance screw
66S Load spring
66K Solid material
70 Endless belt-shaped intermediate transfer body
71, 72, 73, 74 Roller
82L, 82R Supporting rail
P Transfer material
251 Substrate
254 Storage tank
255 Pressure pump
260 Coating head
261 Coating liquid outlet
262 Coating liquid distribution outlet
263 Coating liquid distribution chamber
264 Supply pipe
265 Slide face
266 Lip-shaped part
267 Outlet
L Coating liquid
F Coated film

The invention claimed is:

1. An electrophotographic photoreceptor comprising:
a conductive support;
a photosensitive layer formed on the conductive support; and
a surface layer formed on the photosensitive layer,
wherein the surface layer contains barium sulfate composite fine particles in a cured resin, wherein each of the barium sulfate composite fine particles is composed of a core material made from barium sulfate and a conductive metal oxide adhered to the surface of the core material;
a 10 point average roughness RzJIS of the surface layer is not less than 0.2 μm and not more than 1.5 μm; and
a value obtained by an equation n×d is not less than 10,000 (pieces·nm) and not more than 200,000 (pieces·nm) where n represents a peak count of the surface layer and d represents a number average primary particle diameter of the barium sulfate composite fine particles;
the peak count (n) of the surface layer is 20 to 1,000 pieces per length of 8.0 mm;
the number average primary particle diameter of the barium sulfate composite fine particles is 50 to 500 nm;
the barium sulfate composite fine particles are those subjected to a surface treatment with a surface treating agent having a polymerizable functional group.

2. The electrophotographic photoreceptor according to claim 1, wherein the conductive metal oxide in the barium sulfate composite fine particles is at least one kind selected from the group consisting of tin oxide, titanium oxide, zinc oxide, zirconia and indium tin oxide.

3. The electrophotographic photoreceptor according to claim 1, wherein the value obtained by the equation n×d is not less than 20,000 (pieces·nm) and not more than 150,000 (pieces·nm).

4. The electrophotographic photoreceptor according to claim 1, wherein the number average primary particle diameter of the barium sulfate composite fine particles is 75 to 300 nm.

5. The electrophotographic photoreceptor according to claim 1, wherein a content of the barium sulfate composite fine particles in the surface layer is 10 to 200 parts by mass per 100 parts by mass of the cured resin.

6. The electrophotographic photoreceptor according to claim 1, wherein the peak count (n) of the surface layer is 20 to 100 pieces per length of 8.0 mm.

7. An image forming apparatus comprising:
an electrophotographic photoreceptor;
a charging unit for charging a surface of the electrophotographic photoreceptor;
an exposure unit for forming an electrostatic latent image on the surface of the electrophotographic photoreceptor;
a developing unit for developing the electrostatic latent image with a toner to form a toner image;
a transfer unit for transferring the toner image to a transfer material;
a fixing unit for fixing the toner image transferred to the transfer material; and
a cleaning unit for removing a residual toner on the electrophotographic photoreceptor,
wherein the electrophotographic photoreceptor is the electrophotographic photoreceptor according to claim 1.

8. The image forming apparatus according to claim 7, wherein the cleaning unit is a blade.

* * * * *